United States Patent [19]

Schips

[11] Patent Number: 4,928,608

[45] Date of Patent: May 29, 1990

[54] APPARATUS FOR JOINING THE POCKET TRIMMING AND THE POCKET BAG IN TROUSER POCKETS

[76] Inventor: Helmut Schips, Klosterweidlistrasse 1, CH-9010 St. Gallen, Switzerland

[21] Appl. No.: 28,568

[22] Filed: Mar. 20, 1987

[30] Foreign Application Priority Data

Mar. 24, 1986 [CH] Switzerland ..... 01171/86

[51] Int. Cl.[5] ..... D05B 21/00

[52] U.S. Cl. ..... 112/121.12; 112/147; 112/104

[58] Field of Search ..... 112/121.12, 121.11, 112/121.15, 147, 141, 104, 215.1, 147, 148, 10, 65, 150

[56] References Cited

U.S. PATENT DOCUMENTS

| | | | |
|---|---|---|---|
| 2,413,891 | 1/1947 | Roy | 112/121.15 |
| 3,277,851 | 10/1966 | Dobner et al. | 112/147 |
| 3,381,640 | 5/1968 | Davidson | 112/150 X |
| 4,068,603 | 1/1978 | Arbter | 112/147 X |
| 4,279,209 | 7/1981 | Discont, Jr. | 112/104 |
| 4,448,626 | 5/1984 | Off et al. . | |
| 4,463,697 | 8/1984 | Vogt et al. | 112/121.15 X |
| 4,633,793 | 1/1987 | Engel | 112/121.11 |
| 4,685,407 | 8/1987 | Junemann | 112/121.12 X |

FOREIGN PATENT DOCUMENTS 2131278 6/1984 United Kingdom .

*Primary Examiner*—H. Hampton Hunter
*Attorney, Agent, or Firm*—Burns, Doane, Swecker & Mathis

[57] ABSTRACT

An apparatus for joining the pocket bag (I) and the pocket trimming (II) in trouser pockets, with a folded fabric edge of the pocket trimming (II) being sewn by means of a sewing-machine (4) to the pocket bag (I) consisting of lining material. For rapid, automatic preparation of a pocket bag (I) together with a pocket trimming (I) having a folded fabric edge to be sewn to said pocket bag (I), as well as for rapidly and automatically supplying said bag and said trimming to the sewing operation in continuously following manner to said preparation step, it is provided according to the present invention that a folding means (5) and a material conveyor (6) for conveying the material to be sewn are associated with the sewing-machine (4). The folding means, as seen in sewing feed direction, is located in front of the sewing-machine (4) whereas the material conveyor (6) is provided between the folding means (5) and the sewing-machine (4).

12 Claims, 7 Drawing Sheets

51
52
513
512
522
523
527
517
I
2
22
41
5110
529
513
519
53
31
5

51
52
I
II 51
52
I
II 51
52
I
II 61
52
51
I
II 51
52
I
II
22
62
23

APPARATUS FOR JOINING THE POCKET TRIMMING AND THE POCKET BAG IN TROUSER POCKETS

The invention relates to an apparatus for joining the pocket trimming and the pocket bag in trouser pockets, with a folded fabric edge of the pocket trimming being sewn by means of a sewing-machine to the pocket bag consisting of lining material.

In the case that an unfolded fabric edge of the pocket trimming is sewn to the pocket bag, the thread of the two-needle chain stitch usually employed therefor is subject to excessive wear despite the provision of an additional covering or overlapping thereof, and this wear leads to rapid disintegration of the connection between pocket bag and pocket trimming. In order to counteract such undesirable wear, one has turned to a kind of manufacture in which the fabric edge of the pocket trimming was folded by hand before sewing it to the pocket bag, whereafter said trimming and said bag were held together and fed in this state to a sewing-machine, which again took place by hand. This kind of manufacture does in fact permit the use of a simpler one-needle chain stitch or one-needle backstitch instead of the two-needle stain stitch with covering, however, it is complicated, time-consuming and necessitates experienced abilities.

This is where the present invention starts. The object to be met by the present invention is to provide an apparatus of the initially described type, which permits a rapid preparation of a pocket bag together with a pocket trimming to be sewn thereto with a folded fabric edge and which permits the supply of said pocket bag and said pocket trimming to the sewing operation in continuously following manner to said preparation step. According to the present invention, this object is met with the aid of the features indicated in the characterizing part of claim 1. The preparation and carrying out of the sewing operation of pocket trimming and pocket bag can thus be performed extremely rapidly, without time-consuming manipulations and independently of the expert abilities of the operator, with the pocket trimming being nevertheless sewn to the pocket bag with an exactly folded fabric edge and with the use of a one-needle stitch only. An additional acceleration of manufacture is rendered possible by the fact that during a running sewing operation, a next unit of material to be sewn, consisting of a pocket bag and a pocket trimming with folded fabric edge pressed against said bag, can be prepared.

Particularly advantageous features and developments of a preferred embodiment of the invention are the subject matter of dependent claims 2 to 8.

The invention will be elucidated by way of example on the basis of a preferred embodiment with reference to the accompanying drawings, in which FIG. 1 shows an elevation view of an apparatus according to the invention;

Figure 1:
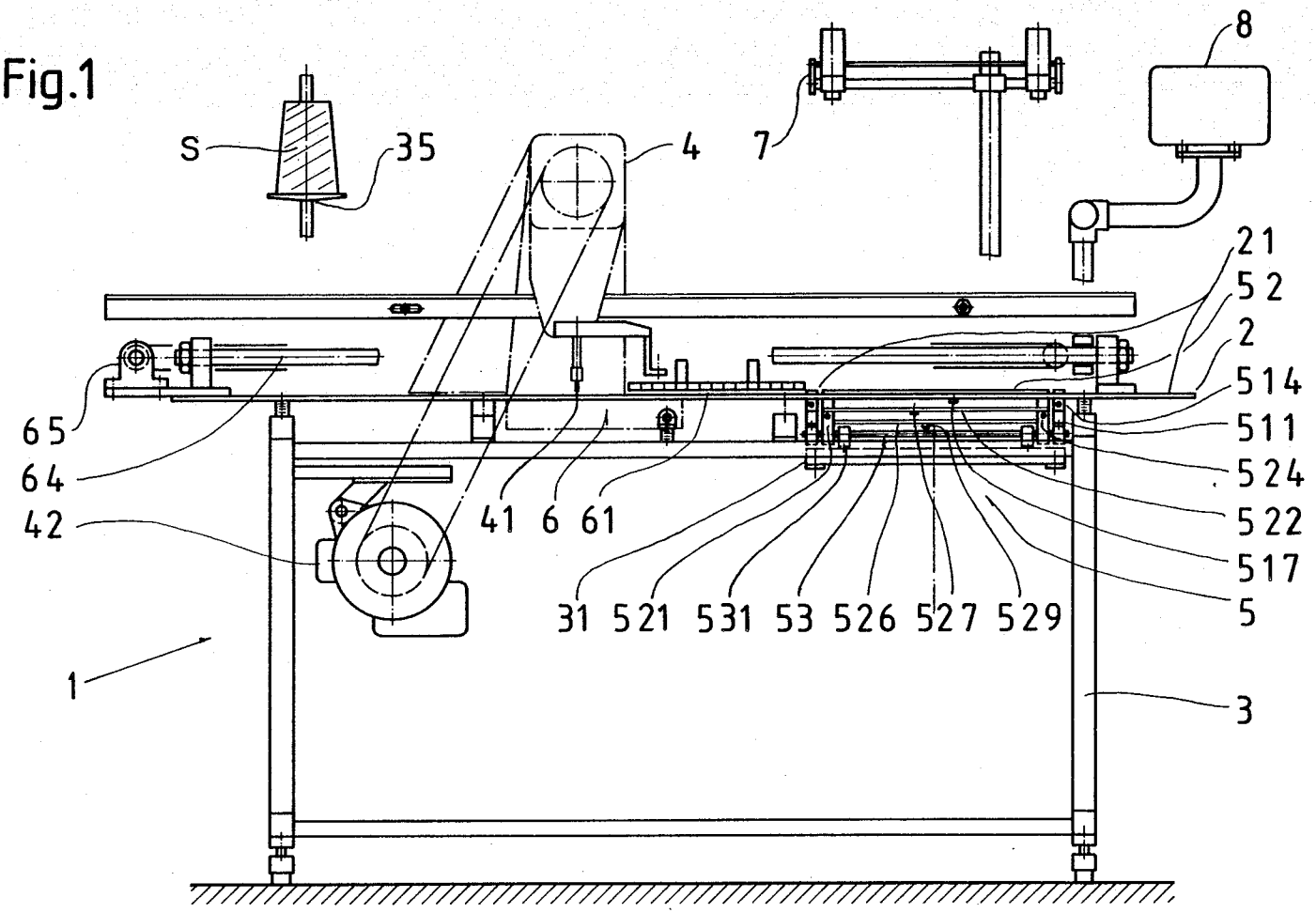
Figure 2:
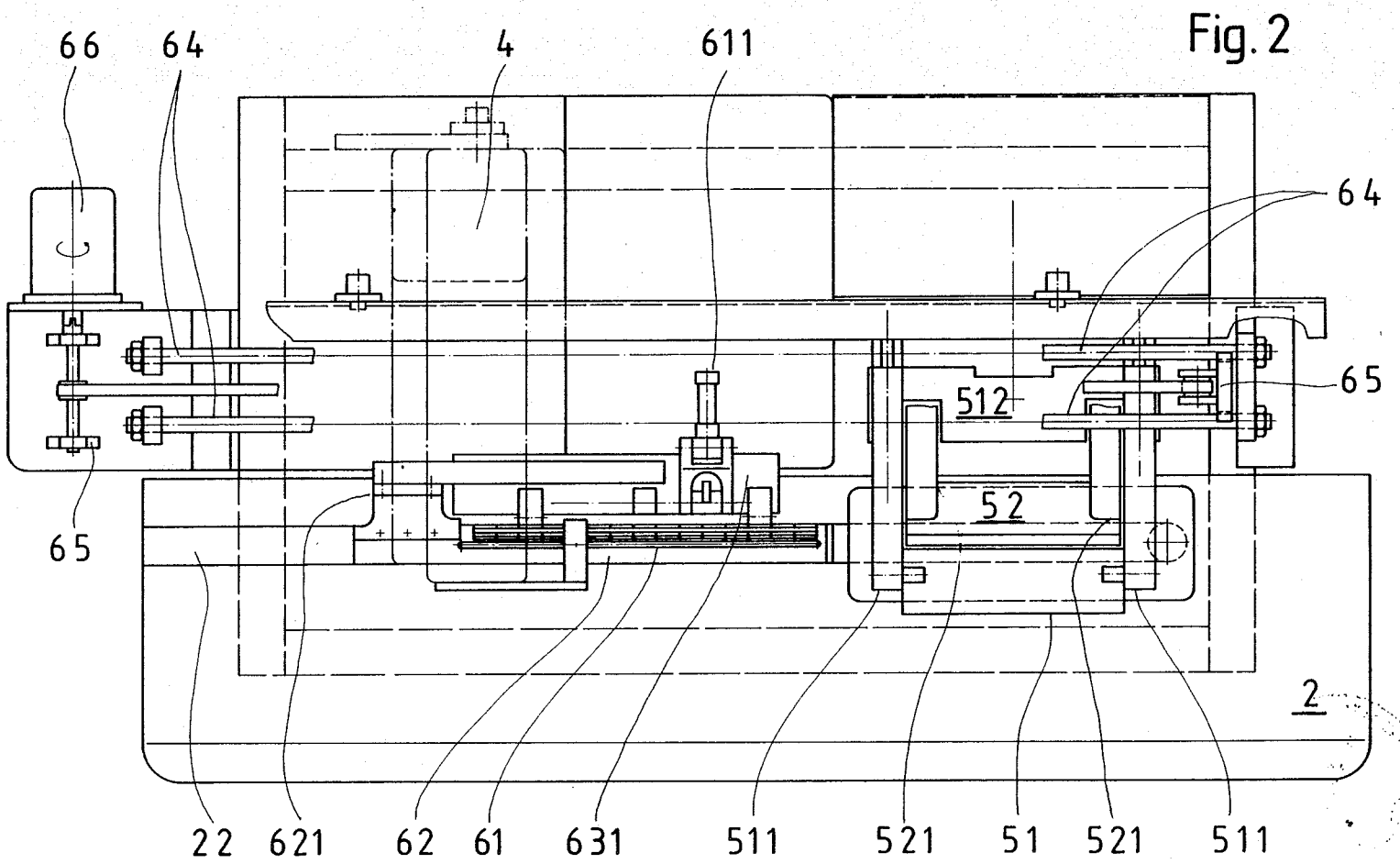
FIG. 2 shows a plan view of the apparatus according to FIG. 1.

The apparatus according to the invention, which is shown in FIGS. 1 and 2 and which could also be designated as "automatic apparatus for folding and sewing pocket trimming", is composed of a working table 1, a sewing-machine 4 anchored in the middle portion of the elongate table plate 2 of the working table 1 in the frame 3 thereof, a folding means 5 disposed above the receiving side 21 of the table plate 2 (right-hand end portion of said plate in FIGS. 1 and 2) and serving for preparing a pocket bag I and a pocket trimming II to be sewn thereto with folded fabric edge (cp. FIG. 3), and a material conveyor 6 for conveying the material to be sewn. The direction of movement of the material conveyor 6 is selected such that it extends from the folding means 5 past the sewing needle 41 of the sewing-machine 4 to the end of the table plate remote from the folding means 5 (the end of the left-hand side in FIGS. 1 and 2).

The folding means comprises a folding plate 51 and a holding-down plate 52. With the aid of corresponding actuation drives, these plates are pivotable up and down relative to the table plate 2 and are linearly displaceable transversely of the longitudinal extension of said plate 2, as will be elucidated in more detail hereinbelow in connection with FIGS. 3 to 5. The plates co-operate with each other and at the same time also with the table plate 2.

As can be seen in FIGS. 1, 3, 4 and 5, the folding plate 51 and the holding-down plate 52 are each connected, each via a pair of side arms 511 and 521, respectively, to a supporting plate 512 and 522 respectively, supporting at each one of its ends a bushing 513 and 523 respectively. The bushings 513 and 523 of each supporting plate 512 and 522, respectively, are each slidably disposed on a guide rod 514 and 524, respectively; each guide rod is associated with a base carrier 515 and 525, respectively. The two ends of each pair of base carriers 515 and 525, respectively, for the folding plate 51 and the holding-down plate 52, respectively, are connected to each other on the one hand by means of a prop 516 and 526, respectively, with the prop 516 and 526 remoter from the folding plate and the holding-down plate 51 and 52, respectively, each receiving a pressure cylinder 517 and 527 for movement of the folding plate and the holding down plate 51 and 52, respectively, along the guide rods 514 and 524, respectively. On the other hand, the base carriers 515 and 525, respectively, are disposed in freely rotatable manner on a shaft 53 by means of bearings 518 and 528, respectively, provided on the underside thereof, with the shaft being immovably connected to the frame 3 of the working table 1 by means of bearing blocks 531 and a supporting bracket 31. Power drives serving for independent pivoting of each base carrier 515 and 525 respectively, along with the folding plate 51 and the holding-down plate 52, respectively, are pivotably mounted between the base carriers 515 and 525 respectively, and the frame 3. While a pressure cylinder 519 is provided for pivoting out the folding plate 51 from the horizontal into an inclined position, and a tension spring 5110 is provided for pivoting said folding plate back into the horizontal position in the non-prescribed condition of said pressure cylinder 519, an additional pressure cylinder 529 is provided solely for pivoting the holding-down plate 52 in both directions.

The pressure cylinder 519 serving for pivoting out the folding plate 51 is pivotably mounted to the bottom side of the prop 516 which also receives the pressure cylinder 517 for displacing said plate. The tension spring 5110 provided for pivoting the folding plate 51 back into the horizontal position engages the prop 516 located closer to the folding plate 51. The pressure cylinder 529 which is associated with the holding-down plate 52 as the pivot drive is in operational connection with the prop 526 located closer to said plate.

As can be seen especially in FIG. 2, the holding-down plate 52 is disposed within the frame formed by the folding plate 51 and its suspension.

The material conveyor 6 is directly adjacent the folding means 5, as can be seen especially in FIG. 2. The members of the material conveyor 6 which take along the material to be sewn, are a multi-member sewing clip 61 and a rail 62 located therebeneath. The sewing clip 61 consists of a number of members which are coupled to each other and which, similarly to the members of a chain, are movable in limited manner relative to each other and are provided with teeth on the lower side for gripping the material to be sewn. The rail 62 is supported in longitudinally displaceable manner in a groove 22 of the table plate 2, which extends beneath the sewing clip 61.

A carriage 63 is slidably disposed on two guide columns or bars 64 mounted on the working table 1 and extends parallel to the table plate 2 in an elevated position with respect thereto. The carriage 63 is adapted to be moved by means of a belt drive 65 operated by motor 66 and threaded between the two guide rails 64 e.g. to the central portion of the carriage 63. The sewing clip 61 is pivotably mounted on a side plate 631 of the carriage 63 and is in operational connection with a pressure cylinder 611 which is also disposed on the side plate 631 and by means of which the sewing clip 61 can be lowered, while performing a pivoting motion towards a material to be sewn which is placed onto the rail 62 located therebeneath and which is prepared by the folding means 5 and consists of a pocket bag I and of a pocket trimming II having a folded fabric edge and being pressed onto the pocket bag I; by means of said pressure cylinder 611 the sewing clip 61 can be lifted off from the material after the sewing operation. The rail 62 is also fixedly connected to the carriage 63 via a rectangular arm 621.

FIG. 1 shows, furthermore, a holder 35 for thread bobbins S which is disposed above the table plate 2 to the left of the sewing-machine 4, and to the right of the sewing-machine 4 a commonly known light marking device 7 as well as a programmable control means 8, all of these means being secured to the frame 3 of the working table 1. The light marking device 7 which detects the presence of fabric when the fabric obstructs a light beam, serves for locating or defining an exact mutual sewing position of a pocket bag I and a pocket trimming II to be sewn thereto with a folded fabric edge. The programmable control means 8 causes the actuation of the pressure cylinder 517, 519, 527, 529 of the folding means 5 as well as of the drives 611 and 66 of the material conveyor 6 in their programmed sequence each and, thus, automatically guides the operating cycle of the apparatus according to the invention.

Figure 6:
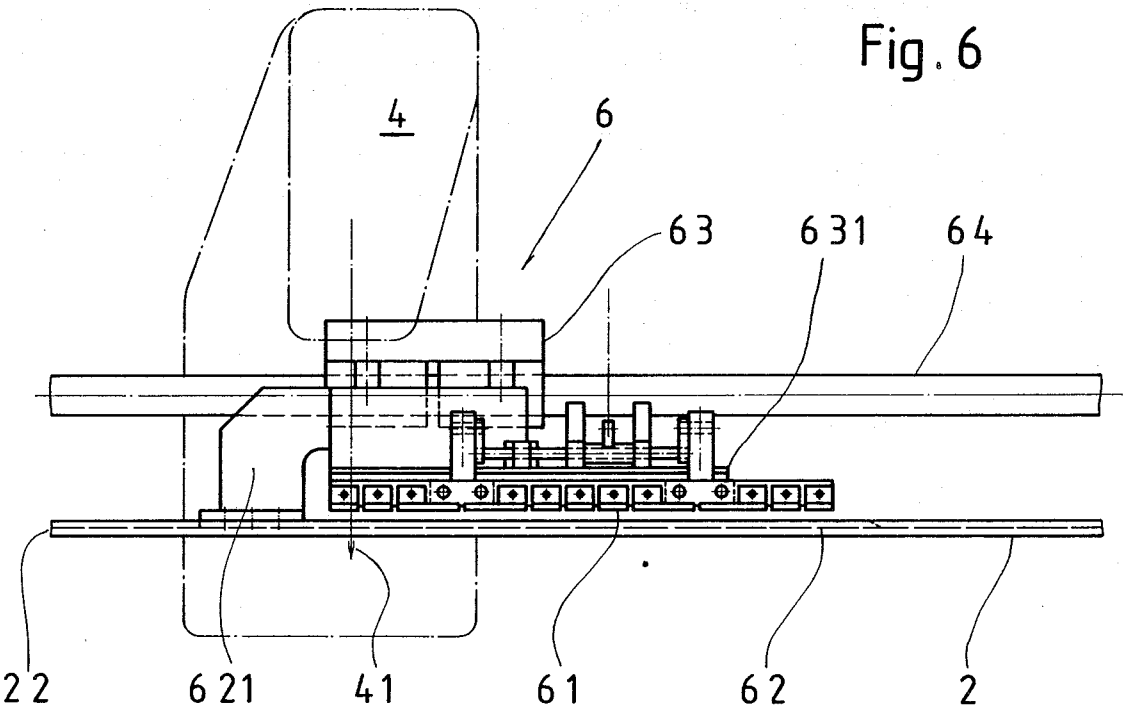
FIG. 6 shows an enlarged front view of a material conveyor according to the invention.
Figure 8:
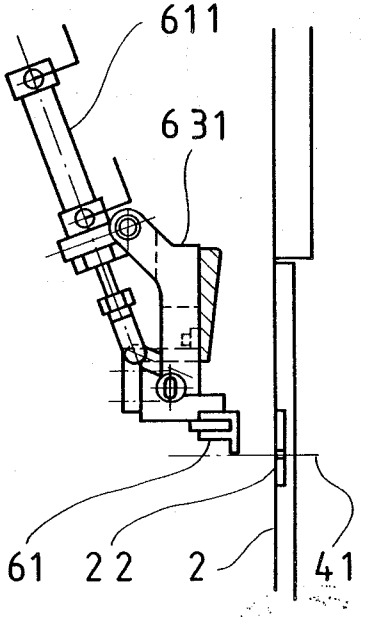
FIG. 8 shows a side view of an actuation drive associated with the material conveyor for lifting and lowering said conveyor.
Figure 7:
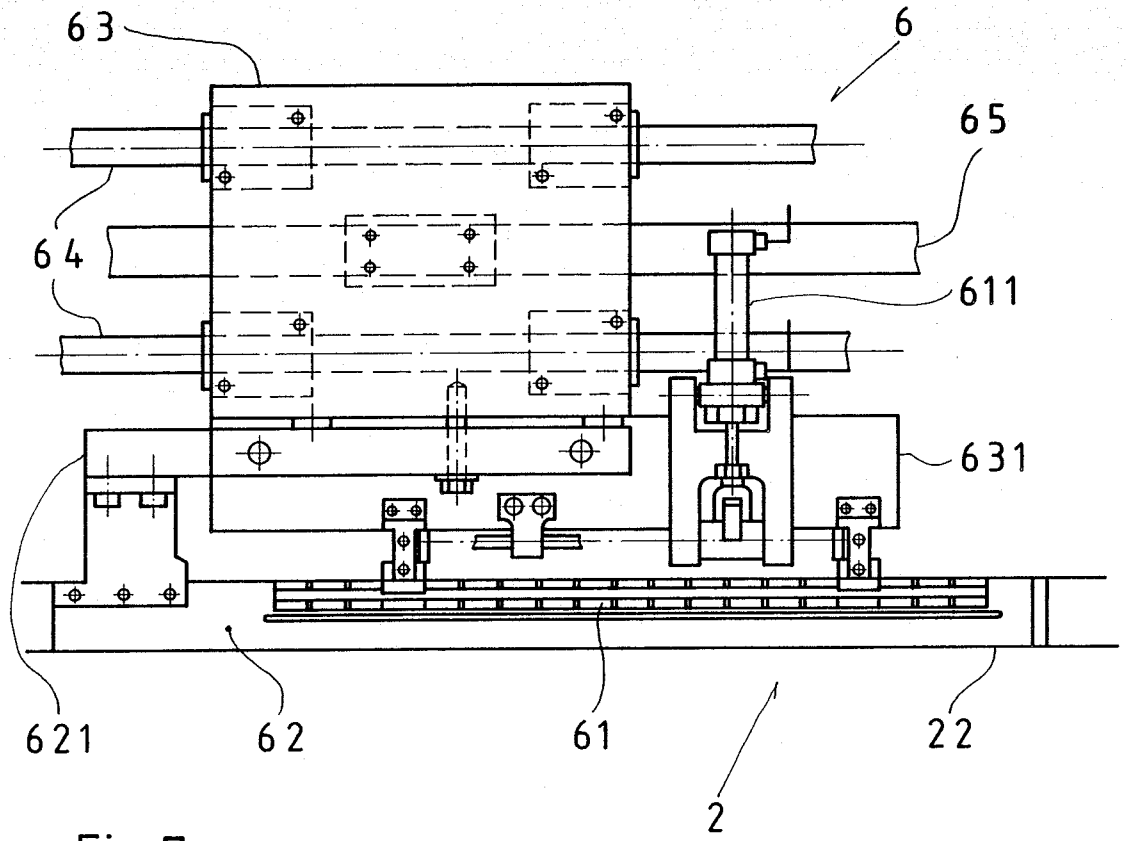
FIG. 7 shows an enlarged plan view of the material conveyor according to FIG. 6.

FIG. 1 shows, furthermore, the sewing needle 41 of the sewing-machine 4 immediately above the table plate 2 and to the left of the sewing clip 61 located in its end position on the right-hand side beside the folding means 5 for taking over prepared material to be sewn, and on the left-hand side of the frame 3 below the table plate 2, FIG. 1 shows an electric motor 42 for driving the sewing-machine 4. The position of the sewing needle 41 in relation to the path of movement of the sewing clip 61 moving past the needle is shown by a broken line in FIGS. 3, 6 and 8.

The described apparatus permits the following mode of operation which is elucidated in FIG. 3 on the basis of schematic views *3a* to *3f*.

Figure 4:
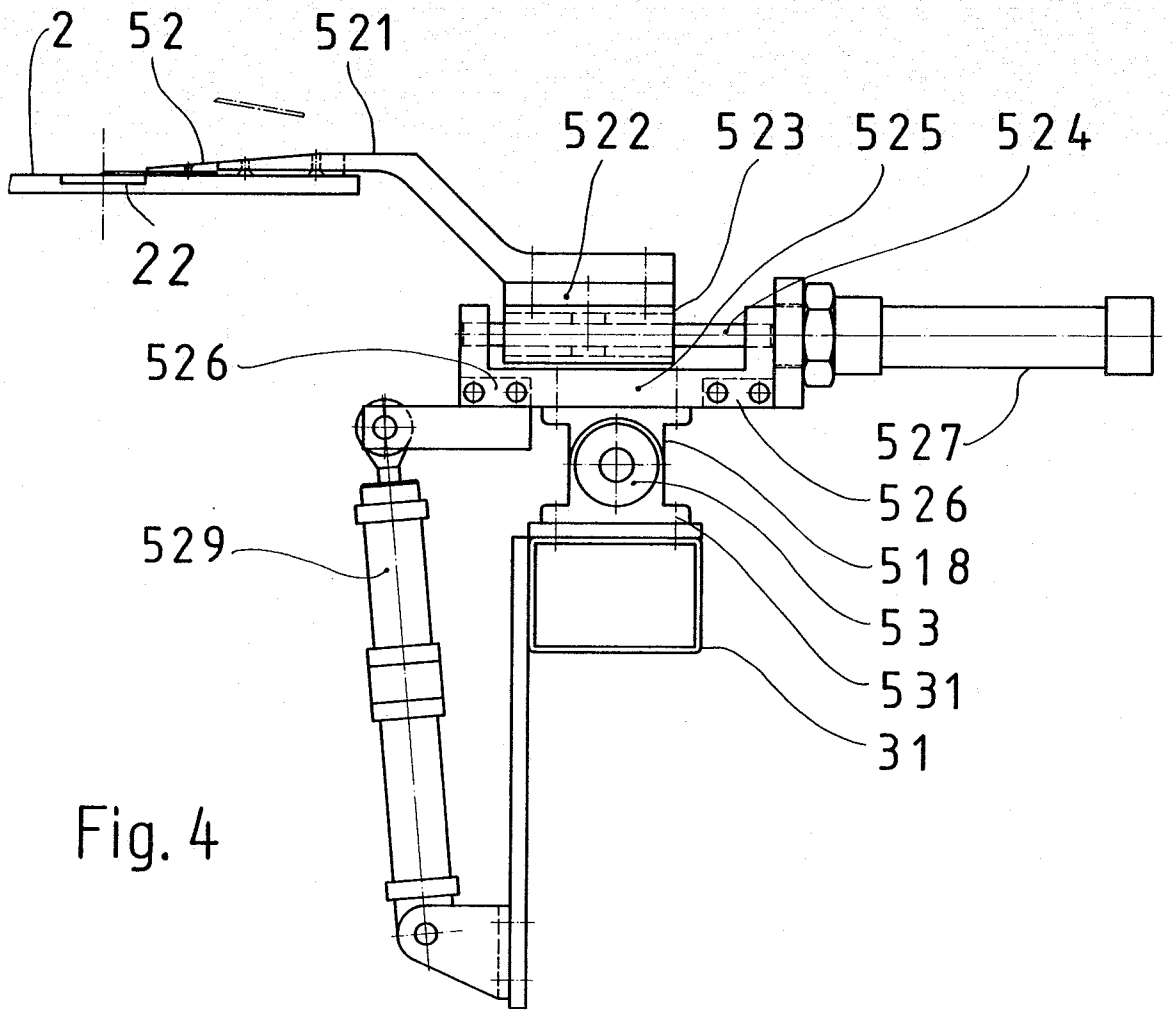
FIG. 4 shows an enlarged view of the holding-down plate of the folding means according to FIGS. 1 and 2 along with the actuation drives thereof.
Figure 5:
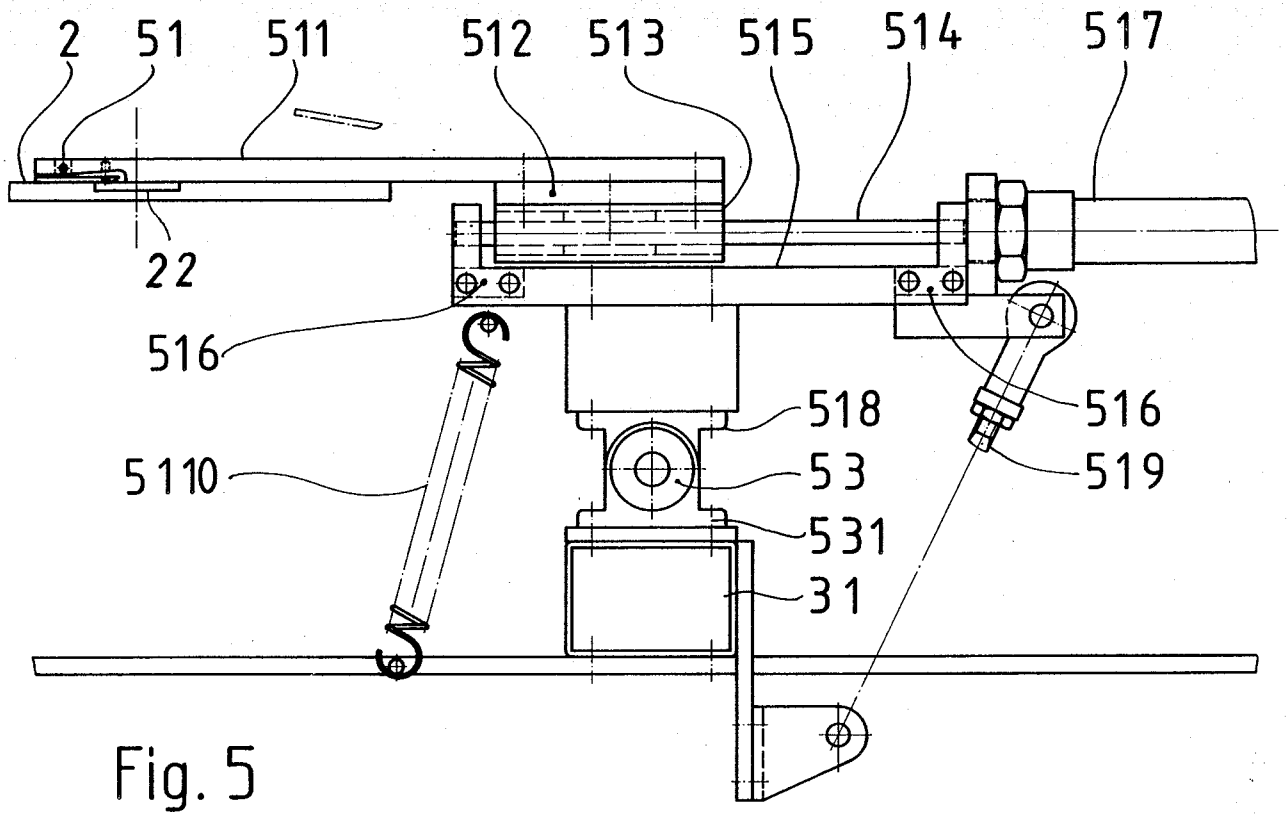
FIG. 5 shows an enlarged view of the folding plate of the folding means according to FIGS. 1 and 2, again along with the associated actuation drives.

At the beginning of the operation, the folding means 5 takes the initial position outlined in respect of FIG. *3a* at the upper right-hand side, in which the folding plate 51 and the holding-down plate 52 are both pivoted upwardly from their horizontal position and are located at the forward stop of their guide bars 514, 524 (cp. also FIGS. 4 and 5).

As regards the remaining FIGS. *3b* to *3f*, only the shaft 53 is outlined which serves for pivotably supporting the folding and the holding-down plate 51 and 52.

As the first step, a pocket bag I of desired size, which consists of lining material, is placed beneath the folding plate and the holding-down plate 51 and 52 on the table plate 2 in accordance with the light marks of the light marking device 7, and at the same time the groove 22 of the table plate 2 is covered thereby (cp. FIG. *3a*).

With the aid of a foot-operated key, for instance, which is not shown, the lowering of the folding plate 51 towards the pocket bag I is effected, said lowering operation taking place without pressurization of the pressure cylinder 519 solely with the force of the tension spring 5110 in order to pivot the folding plate 51. As can be seen from FIG. *3b*, a pocket trimming II, which again is positioned with the aid of light marks, is placed onto the folding plate 51.

The further operation of the apparatus, which is then initiated by a second command pulse by means of the foot-operated key, then takes place automatically. During this operation, the holding-down plate 52 is at first also lowered and presses, with its sharp-edged side, a fabric edge of the pocket trimming II against the pocket bag I located therebeneath (cp. FIG. *3c*).

Immediately thereafter the pressure cylinder 517 pulls the folding plate 51 extremely rapidly back to the rearward stop thereof on the associated guide bars 514 so as to shift said plate linearly, with the folding plate 51 at first slightly rising and pushing the pocket trimming II ahead of it with its sharp-edged side, and then sliding closely past the holding-down plate 52 and at the same time folding the pocket trimming II about the sharp-edged side thereof. FIG. *3d* shows the slightly folding plate 51 prior to its movement past the holding-down plate 52, while FIG. *3e* shows the position of the two plates 51, 52 after the folding operation.

The slight raising of the folding plate 51, by pulling it by means of the pressure cylinder 517, is rendered possible solely on the basis of the elasticity of the tension spring 5110, with the pivoting cylinder 519 of the folding plate 51 remaining non-pressurized.

FIG. *3e* shows furthermore that immediately after the folding operation the sewing clip 61, which is in a raised position, is moved over the folded pocket trimming II as well.

Figures 3A, 3B, 3C, 3D, 3E, 3F:
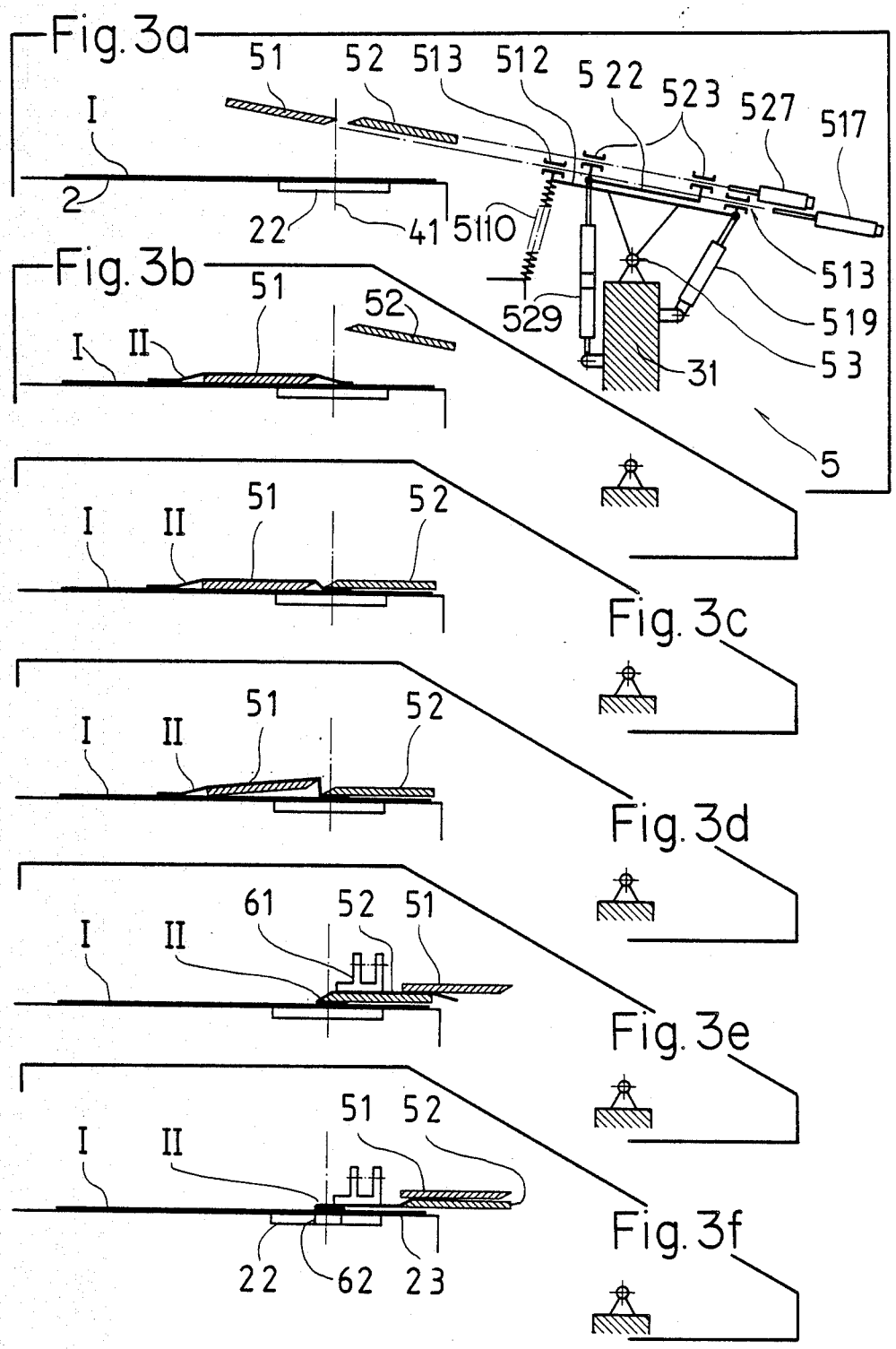
FIG. 3A–FIG. 3F shows schematic views illustrating the mode of operation of a folding means according to the invention.

Thereafter, the holding-down plate 52 is withdrawn into its rearward end position by means of the pressure cylinder 527 provided for linearly shifting said plate, and at the same time the sewing clip 61 is pivoted downwardly, with the aid of the pivot drive thereof, i.e. the pressure cylinder 611, onto the material prepared by the folding means and consisting of folded pocket trimming II and pocket bag I located therebelow. The material to be sewn is thus clamped between the sewing clip 61 and the rail 62 moved along therewith in the groove 22 of the table plate 2 (cp. FIG. 3*f*).

In order to prevent slippage of the pocket bag I during withdrawal of the holding-down plate 52, the surface of the table plate 2 to the right of the groove 22 thereof is provided with an adhesive coating 23 as shown in FIG. 3*f*.

Finally, the folding plate 51 and the holding down plate 52 successively return to their respective initial position and are placed in readiness for the next folding operation, whereas the material conveyor 6 conveys the prepared material to be sewn to the sewing position under the sewing needle 41 of the sewing machine 4 and, after termination of the sewing operation, conveys the material to a deposit means in the vicinity of the end of the table plate 2 facing away from the folding means 5. After deposit of a finished piece of sewn material, the material conveyor 6 moves into its waiting position.

I claim:

1. An apparatus for joining a pocket bag to a pocket trimming at a folded fabric edge of the pocket trimming comprising means for sewing said pocket bag with said pocket trimming, means for folding said pocket trimming prior to sewing, and means for conveying said pocket bag and said pocket trimming to said means for sewing after folding of said pocket trimming, said means for folding comprising a folding plate and a holding-down plate, each of which is power operable and arranged to be pivotable up and down relative to a table plate and linearly displaceable in a direction transverse to a longitudinal extension of the table plate, said folding plate and said holding-down plate being movable independently of each other, said folding plate including a pressure cylinder for pivoting said folding plate upwardly from a horizontal position into an inclined position relative to said table plate, and a tension spring for pivoting said folding plate downwardly into a horizontal position relative to said table plate, said holding-down plate including a pressure cylinder for pivoting said holding-down plate both upwardly from a horizontal position into an inclined position relative to said table plate and downwardly into a horizontal position relative to said table plate, said folding plate and said holding-down plate each having a pressure cylinder for linearly disposing said folding plate and said holding-down plate relative to said table plate.

2. An apparatus according to claim 1, wherein said means for sewing is disposed in a middle portion of said platform, and said means for positioning is disposed upstream of said means for sewing in a sewing feed direction.

3. An apparatus according to claim 1, wherein said means for conveying said pocket assembly is disposed adjacent said means for positioning and has a direction of movement extending past a sewing needle of said means for sewing to an end of said platform opposite said means for positioning.

4. An apparatus according to claim 1, wherein said means for folding and said means for holding which are power-operable and arranged to be pivotable up and down relative to said platform.

5. An apparatus according to claim 1, wherein said light means for guiding is disposed above said means for positioning.

6. An apparatus according to claim 4, wherein said means for folding and said means for holding are movable independently of each other, said means for folding including a pressure cylinder for pivoting said means for folding upwardly from a horizontal position into an inclined position relative to said table plate, and a tension spring for pivoting said means for folding downwardly into a horizontal position relative to said platform, said means for holding including a pressure cylinder for pivoting said means for holding both upwardly from a horizontal position into an inclined position relative to said platform and downwardly into a horizontal position relative to said platform, said means for folding and said means for holding each having a pressure cylinder for linearly displacing said means for folding and said means for holding relative to said platform.

7. An apparatus according to claim 1, wherein said means for conveying said pocket assembly further comprises a sewing clip including a plurality of gripping members for gripping said pocket assembly, said gripping members being movable relative to each other and being toothed at their underside, said gripping members being power-operable so as to be liftable off of and lowerable onto said pocket assembly and displaceable in a sewing feed direction, said lower member being disposed in a groove of said platform located underneath said sewing clip, said lower member being power-operable so as to be displaceable in the sewing feed direction.

8. An apparatus according to claim 7, wherein said sewing clip is pivotably connected to a side plate of a carriage and said lower member is fixedly connected to said carriage, said carriage being disposed on two guide bars mounted to said means for supporting and slidable along said two guide bars by means of a belt drive interconnected with said carriage and anchored to said means for supporting and operable by a motor, said carriage having a pressure cylinder disposed on said side plate of said carriage, said pressure cylinder being arranged to pivotably lower said sewing clip onto said pocket assembly prior to sewing thereof such that said pocket assembly is placed onto said lower member, said pressure cylinder being arranged to pivotably raise said sewing clip from said pocket assembly after a sewing operation has been performed.

9. An apparatus according to claim 7, further comprising a programmable control means for automatic operation of said means for positioning and said means for conveying said pocket assembly.

10. An apparatus for joining a pocket trimming with a pocket bag, comprising:

means for supporting said pocket bag having a platform with a longitudinal axis in a conveying direction of said apparatus;

means for positioning said pocket trimming and said pocket bag to form a pocket assembly, said means for positioning including a means for holding an edge area of said pocket trimming onto said pocket bag and a means for folding said pocket trimming over said holding means to form said pocket assembly;

said means for holding and said means for folding being movable between an upper position wherein said pocket bag is insertable onto said means for supporting and a lower position wherein said means for holding and means for folding engage portions of said pocket bag and said pocket trimming, said means for holding and said means for folding being movable in a direction transverse to said longitudinal axis;

light means for guiding the positioning of said pocket bag on said support means and for the positioning of said pocket trimming on said means for folding;

means for sewing said pocket trimming to said pocket bag along said edge area of said pocket trimming, said means for sewing located adjacent said means for positioning;

means for conveying said pocket assembly from said means for positioning to said means for sewing, said means for conveying having a lower member and an upper member for clamping said pocket assembly at a location of said means for positioning.

11. An apparatus according to claim 10, wherein said platform includes an elongated groove along said longitudinal axis for guiding said lower member of said means for conveying.

12. An apparatus for joining a pocket bag to a pocket trimming at a folded fabric edge of the pocket trimming comprising means for sewing said pocket bag with said pocket trimming, means for folding said pocket trimming prior to sewing, and means for conveying said pocket bag and said pocket trimming to said means for sewing after folding of said pocket trimming, said means for conveying said pocket bag and said pocket trimming comprising a sewing clip including a plurality of gripping members for gripping said pocket bag and said pocket trimming, said gripping members being movable relative to each other and being toothed at their underside, said gripping members being power-operable so as to be liftable off of and lowerable onto said pocket bag and said pocket trimming and displaceable in a sewing feed direction, said means for conveying said pocket bag and pocket trimming further including a rail which is disposed in a groove of a table plate located underneath said sewing clip, said rail being power-operable so as to be displaceable in the sewing feed direction, said sewing clip being pivotably connected to a side plate of a carriage and said rail being fixedly connected to said carriage, said carriage being disposed on two guide bars mounted to said working table and slidable along said two guide bars by means of a belt drive interconnected with said carriage and anchored to said working table and operable by a motor, said carriage having a pressure cylinder disposed on said side plate of said carriage, said pressure cylinder being arranged to pivotably lower said sewing clip onto the pocket bag and pocket trimming after folding and prior to sewing thereof such that said pocket bag and pocket trimming are placed onto said rail, said pressure cylinder being arranged to pivotably raise said sewing clip from said pocket bag and pocket trimming after a sewing operation has been performed.

* * * * *